US006027065A

United States Patent [19]

Stahlecker

[11] Patent Number: 6,027,065

[45] Date of Patent: Feb. 22, 2000

[54] YARN TRAVERSING DEVICE ON TEXTILE MACHINES PRODUCING CROSS-WOUND PACKAGES

[75] Inventor: Gerd Stahlecker, Eislingen, Germany

[73] Assignee: Novibra GmbH, Suessen, Germany

[21] Appl. No.: 09/032,921

[22] Filed: Mar. 2, 1998

[30] Foreign Application Priority Data

Mar. 5, 1997 [DE] Germany ..... 197 08 936

[51] Int. Cl.[7] ..... B65H 54/28

[52] U.S. Cl. ..... 242/482.8; 242/483.5

[58] Field of Search ..... 242/483.5, 482.8, 242/470, 477.2, 132, FOR 195

[56] References Cited

U.S. PATENT DOCUMENTS

| | | | |
|---|---|---|---|
| 1,527,485 | 2/1925 | Malassine et al. | 242/482.8 |
| 3,760,641 | 9/1973 | Espasa | 242/482.8 X |
| 3,858,818 | 1/1975 | Melz | 1/1 |
| 4,006,863 | 2/1977 | Bense | 242/483.5 X |
| 5,344,090 | 9/1994 | Nakai et al. | 242/483.5 X |
| 5,676,324 | 10/1997 | Miyagawa | 242/482.8 |
| 5,676,325 | 10/1997 | Otoshima | 242/482.8 |
| 5,927,638 | 7/1999 | Stahlecker | 242/482.8 |

FOREIGN PATENT DOCUMENTS 38 10734 A1 10/1989 Germany .

*Primary Examiner*—Michael R. Mansen
*Attorney, Agent, or Firm*—Evenson, McKeown, Edwards & Lenahan, P.L.L.C.

[57] ABSTRACT

Traversing rods for a yarn traversing device on textile machines producing cross-wound packages extend over a plurality of winding stations and are subjected alternately to tension and compression. The traversing rod is driven at one end by a traversing drive, and at a distance therefrom, for example at its other end, is driven by an auxiliary traversing device for accelerating its return of motion. This auxiliary traversing device is effective in both directions of motion of the traversing rod, and operates synchronous with a signal given by the traverse drive such that the length changes of long traversing rods are taken into account.

27 Claims, 3 Drawing Sheets

YARN TRAVERSING DEVICE ON TEXTILE MACHINES PRODUCING CROSS-WOUND PACKAGES

BACKGROUND AND SUMMARY OF THE INVENTION

This application claims the priority of German application 197 08 936.4 filed in Germany on Mar. 5, 1997, the disclosure of which is expressly incorporated by reference herein.

The present invention relates to a yarn traversing device on textile machines producing cross-wound packages, comprising at least one traversing rod extending in machine longitudinal direction over a plurality of winding stations and subjected alternately to tension and compression. The traversing rod is driven at one end by means of a traversing drive, and at a distance therefrom, preferably at its other end, can be driven by at least one auxiliary traversing device for accelerating its return of motion, which auxiliary traversing device can be activated for short intervals by a control mechanism.

Traversing rods are alternately accelerated by the traversing gear. The highest tension and compression load occurs with each reversal of motion direction. In particular in the case of long machines, there are considerable delays in the reversal of motion at the machine end facing away from the traversing gear. The mass accelerated in one direction hinders delay-free return of motion. This inertia must be overcome. With one reversal of motion, a considerable elongation of the traversing rods occurs and with the other reversal of motion a corresponding compression of the traversing rods occurs. Length changes in the traversing rods measuring several millimeters occur. In the case of a long machine it is to be feared that the lifting motion is increased in both directions at the machine end, caused on the one hand by elongation and on the other by compression, which results in the dimensions of the packages varying. The yarn guides located on the traversing rods do not undergo their return of motion exactly where they should.

In order to reduce the tension swings during the reversal of motion of such traversing rods, German published patent application 38 10 734 A1 teaches that the traversing rods are connected in the area of their ends to pneumatic energy storers. Towards the end of the motion in a direction of the traversing rod, the air is compressed in a piston-cylinder unit, by means of which a corresponding counterforce is exerted on the traversing rod at the moment of return motion. During the motion towards the piston-cylinder unit, the energy storer is charged, and the stored force effects the acceleration of the return motion.

The known energy storers are designed so that during operation a tension is exerted on the traversing rods, regardless of their direction of motion. The compression forces shall thus be compensated. For this purpose, a blast of compressed air is exerted on a piston connected to the traversing rod, when the traversing rod changes from a tension movement to a compressed movement. This additional compressed air is only effective in one direction of motion. The change in length of the traversing rod is not hereby compensated, but rather its pressure load is. A lighter construction of the traversing rod is thus desirable.

It has also been ascertained that during operation of long textile machines which produce cross-wound packages, the machines are never equally long over a longer period time. The climate plays a role here, as well as heat expansion and other occurrences such as the "strain" of the machine, as it is known in the industry. This strain of the machine applies not only to its height but also to its length. This point is not discussed in German published patent application DE 38 10 734 A1, and due to the additional blast of compressed air which is only effective on one side, this cannot be counteracted.

It should be considered that the "auxiliary traversing device", activated by the additional blast of compressed air, is only then purposeful when it is effective exactly at the same time, to the very millisecond, as the return motion. If the walls of the cylinder and piston alter their distance with respect to one another even slightly as a result of changes in length, than the effect of the auxiliary traversing device is already questionable. If the auxiliary traversing device is effective at the wrong time, it can, in extreme cases, do more harm than good.

It is thus an object of the present invention to take into account the changes in length, caused by the expansion and compression of the long traversing rods, and to generate packages with almost identical dimensions even on those winding stations which are further away from the traversing gear.

This object has been achieved in accordance with the present invention in that the auxiliary traversing device can be activated in both directions of the traversing rod by a synchronous signal given by a traversing gear.

Due to the auxiliary traversing device being activated in both directions of motion, the change in length of the traversing rod during tensile load and during compression are accommodated equally.

The command to activate the auxiliary traversing device at the machine end is given by a non-mechanical means. The signal transmitter for the traversing rod, be it direct or indirect, is the traversing gear itself. In close proximity to the traversing gear there is hardly any falsification which could result in unwanted changes in length of the traversing rod. The return motion in both directions takes place synchronous with the signal from the traversing gear.

In order that elongations are prevented, which can otherwise measure up to 4 to 5 mm, a timely counterforce is effected at the machine end, namely not when the traversing rod reaches the auxiliary traversing device, but when the traversing gear has initiated the return motion. Thus unacceptable elongations and compressions of the traversing rod are at least so far avoided that changes in the lengths of the packages remain within tolerable limits. The auxiliary traversing device is designed so that its exact adjustment in longitudinal direction in relation to the traversing rod is not of great importance. At the moment of desired return motion, clocked by the traversing gear, a counterforce is released, which prevents elongation as well as unacceptable compression.

Traversing gears comprise, as a rule, a cam drum, for example a grooved drum or a beaded drum. Their movements are transmitted directly or indirectly to the traversing rod. In one embodiment of the present invention it is thus provided that the traversing gear comprises a cam drum, and that the cam drum, or a similar component located in close proximity and driven synchronous to the cam drum, contains at least one signal transmitter for the auxiliary traversing device.

Each angle position of this cam drum corresponds to an exactly determined position of the yarn guides located at each winding station, which yarn guides are arranged on the traversing rod. These positions are chonologically and spatially exactly set with respect to their reversal of motion. It is known in which position the cam drum initiates the reverse motion, that is, at which point in time the change from tension to compression and the reverse, takes place. The actual activating of the auxiliary traversing device takes place in a clearly ascertainable and always constant angle position of the cam drum.

The command does not have to come from the cam drum itself. However, the signal transmitter should be arranged at a component which exactly conforms in its movement with the cam drum. The traversing rod itself could be used for transmitting the signal, so long as this occurs at a point which is adjacent to the traversing gear. In this area, practically no unacceptable changes in length occur.

At least one signal receiver is arranged spatially with respect to the signal transmitter, which signal receiver is connected electrically with an initiator of the auxiliary traversing device. When, for example, the cam drum reaches a certain position, the signal receiver receives a signal from the signal transmitter arranged at the cam drum, which signal is electrically relayed to the other machine end. The auxiliary traversing device is thus activated at exactly the right moment.

It can be advantageous when the signal given by the signal transmitter is slightly ahead of the impulse transmitted from the initiator to the auxiliary traversing device. The signal thus arrives slightly prematurely, for example to accommodate delays during opening or closing of a valve. The opening times of such valves are known to be the same over a longer period of time, so that an advance is possible without any negative effects on an exact timing. In this connection it should be mentioned that today there are valves which regulate their own opening and closing times and which transmit any changes registered to a small computer which processes these changes and effects a corresponding adjustment of the initiators.

It is not absolutely necessary to arrange the auxiliary traversing device at the end of the traversing rod. Rather, embodiments are contemplated wherein a plurality of auxiliary traversing devices are provided along the traversing rod. All these auxiliary traversing devices would have the same purpose, namely to speed up and facilitate the return of the traversing movement, and to prevent unacceptable elongations or compressions of the traversing rods occurring. If, for example, an auxiliary traversing device were located at each machine section, then the traverse motion would function ideally. This is, however, a question of cost.

An energy storer, charged by the traversing rod itself, may be arranged at the auxiliary traversing device. The energy storer is charged shortly before the return motion points by means of the kinetic energy and becomes effective, as in prior art mentioned above. For example, a pressure spring can be provided at each section, which pressure spring is compressed towards the end of the lifting movement, and which then gives back the input energy at the moment of return motion. Even if this additional energy storer is not controlled by the traversing gear, the controlled auxiliary traversing device can be effectively supported thereby and can, as required, be executed in a less powerful form.

Advantageously the auxiliary traversing device comprises a pneumatic piston-cylinder unit, which is controlled by the traversing gear and releases a blast of compressed air at the right moment. It is hereby important that the main blast occurs exactly, to the millisecond, at the right moment.

Alternatively, other auxiliary traversing devices are also contemplated. For example, it would be possible at each machine section to insert the traversing rod through an electromagnetic spool. The electromagnets would be connected electrically with the traversing gear, so that they would become effective at the correct time.

If the yarn guides at the winding stations were always controlled to execute their return motion at the same place, poor package edges may be the result. Experience has shown that the edges of the packages improve when they are periodically moved back and forth by small amounts. This is achieved as a rule in that the cam drum is driven periodically to execute small traversing movements. According to the present invention, the signal transmitters and the signal receivers are adapted to the small traversing movements, which involve small distances of up to a maximum of +/−4 mm. If, for example, a pneumatic auxiliary traversing device is used, the additional traversing motion of the cam drum need not be taken into account. The pneumatic cylinders are continually blasted with compressed air when the actual return motion is to take place, independent of the current position of the piston which is connected with the traversing rod. What is essential is that the commands for the return of the direction of motion are given at the correct time.

BRIEF DESCRIPTION OF THE DRAWINGS

These and further objects, features and advantages of the present invention will become more readily apparent from the following detailed description thereof when taken in conjunction with the accompanying drawings wherein.

DETAILED DESCRIPTION OF THE DRAWINGS

Figure 1:
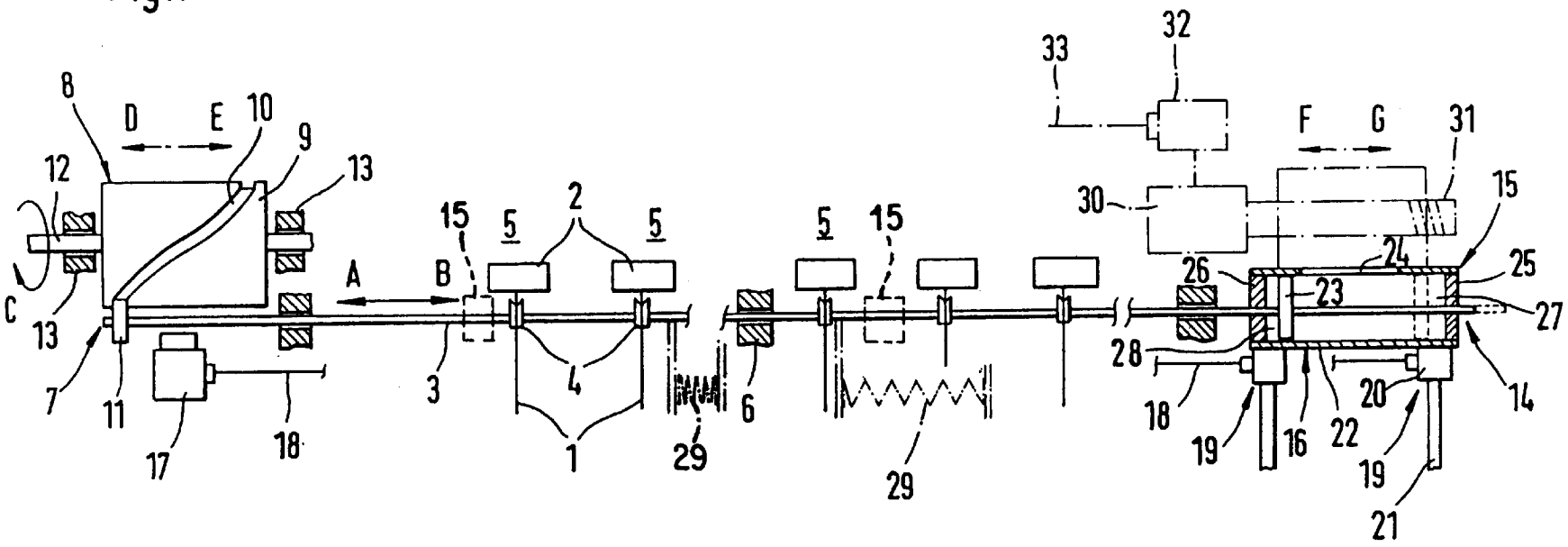
FIG. 1 is a schematic representation of a yarn traversing device of a textile machine which produces cross-wound packages, constructed according to preferred embodiments of the present invention.

The yarn traversing device as shown in FIG. 1 serves to traverse the yarns 1, spun on a spinning machine, which are to be wound onto cross wound packages 2. The traverse motions according to the directions of motion A and B are derived from a traversing rod 3 extending in machine longitudinal direction, which traversing rod 3 is provided at each winding station 5 with a yarn guide 4. The traversing rod 3, measuring up to 30 m in length, is supported on a plurality of bearing points 6 on the machine.

At one end 7, the traversing rod 3 is driven by a traversing gear 8 to execute traversing movements. The traversing gear 8 comprises a cam drum 9, which is provided in a known way with a bead or a groove 10. This drives a guiding element 11 of the traversing rod 3 to traverse movements according to the directions of motion A and B.

The cam drum 9 is arranged on a drive shaft 12, which is rotatably driven in a way not shown in detail, to rotate according to the direction of rotation C. The drive shaft 12 is rotatably supported in bearings.

An auxiliary traversing device 15 is arranged at the other end of the traversing rod 3, which device 15 accelerates the return motion of the traversing rod 3 thus preventing, as far as is possible, any change in length of the traversing rod 3. In the present case the auxiliary traversing device 15 takes the form of a pneumatic piston-cylinder unit 16.

As already mentioned, there are problems with long machines due to the physically induced inertia of the traversing rod 3, which is strongly loaded each time during return motion, once by tension, once by compression. In the case of a machine of approximately 30 m in length, the elongation or compression of the traversing rod 3 can measure up to 4 mm or more. This elongation and compression of the traversing rod 3 has the disadvantage that the packages 2, with respect to their length, can become uneven, in particular in the area of the machine end facing away from the traversing gear 8. The yarn guides 4 do not execute their return motion exactly where they should due to this elongation and compression unless measures are taken according to preferred embodiments of the present invention.

An additional observation is that the machine does not measure exactly the same length every day and over a longer period of time. This also applies to the traversing rod 3. For this reason, it is provided according to the invention that the activating of the auxiliary traversing device 15 does not take place by means of components of the traversing rod 3 in this area, but rather by non-mechanical means, preferably with a short delayed time-span. This command is to activate the auxiliary traversing device 15 before the traversing rod 3 undergoes elongation or compression.

A signal transmitter (not shown in FIG. 1 but schematically depicted in FIGS. 2 and 3) is therefore arranged at the traversing gear 8, preferably the cam drum 9, adjacent which signal transmitter in turn a signal receiver 17 is arranged. In close proximity to the traversing gear 8 there is as yet no significant falsification brought about by changes in length. The activation of the auxiliary traversing device 15 on both sides can therefore occur at the correct moment synchronous with the cam drum 9. The signal transmitter, described below, can function optically, electrically or capacitively.

The signal receiver 17 is connected by means of an electric wire 18 directly to the two initiators 19 of the auxiliary traversing device 15. In this case, two valves 20 serve as initiators 19, which valves 20 either release or close two compressed air pipes 21 of the piston-cylinder unit 16.

The traversing rod 3 extends with a piston 23 through a cylinder 22, which comprises one or more openings 24 in its central area. The cylinder 22 is closed at both its ends by a wall 25 or 26, through which the sealed traversing rod 3 extends. The piston 23 traverses in the interior of the cylinder 22 almost up to the walls 25,26, while leaving a small clearance 27 or 28 at the moment of return motion. As long as the piston 23 is located in the middle area of the cylinder 22, air can exit through the openings 24. Only in the area of the above mentioned clearances 27 and 28, that is, the actual compression areas, are the openings 24 then no longer effective.

It is not particularly important where the compressed air comes from. Advantageous is a compressed air source for a plurality of machines. The valves 20 are connected electrically by means of optical eyes with the signal receiver 17 and function thus as initiators 19. They receive the signal from the cam drum 9 to shoot in compressed air. When a reference point on the cam drum 9 reaches a particular angle position, the respective initiator 19 receives the signal. The valves 20 are thus alternatingly controlled.

It is also contemplated according to certain embodiments of the invention to provide a plurality of auxiliary traversing devices 15 distributed over the length of the traversing rod 3 as schematically depicted in dash lines in FIG. 1. Thus a change in length can already be prevented in the center area of the traversing rod 3. For cost reasons, however, it is preferable to provide the auxiliary traversing devices 15 at the end 14 of the traversing rod 3 facing away from the traversing gear 8. It is in any case purposeful to provide, at a plurality of places, for example at each section, an energy storer 29 denoted by a dot-dash line, for example in the form of a pressure spring. This energy storer is compressed towards the end of the traversing movement and then gives back the input energy, independent timewise of the compressed air blast in the auxiliary traversing device 15. Deviating from this function of the energy storers 29, the auxiliary traversing devices 15 are effective in both directions of motion A and B of the traversing rod 3.

If the yarn guides 4 were always to carry out their returns of motion at the same place, then poor edges would occur on the packages 2. There would be a risk that the edges would not be secure enough, so that yarn pieces or indeed even longer lengths of yarn would fall off laterally. Experience has shown that the edges of the packages 2 improve when the cam drum 9 is moved from side to side a little, as denoted by the dot-dash lines through the traversing directions D–E. These additional, combined traversing movements, which occur slowly and periodically are described in more detail below with the aid of the following Figures.

In the case of the so-called "edge laying", small distances of approximately +/−4 mm are involved. Both edges of the packages 2 are simultaneously laid in the same direction.

During this additional traversing of the cam drum 9, the piston 23 is also displaced further towards or away from the walls 25,26 in the cylinder 22. The cylinder 22 is adjusted in longitudinal direction in such a way that—taking the additional small traverse movements of the cam drum 9 into account—the return point of the piston 23 always occurs shortly before the walls 25 and 26. As already mentioned above, the length of the machine is uncertain, so that here also the side to side movements of the piston 23 in relation to the walls 25 and 26 are not exactly symmetrical. This means that the signal for return motion, released by the initiators 19, does not always occur so that the piston 23 has exactly the same distance from the respective wall 25,26. The clearances 27 and 28 can thus have varying volumes at the point of return motion. This is, however, irrelevant, as in the case of a pneumatic piston cylinder unit 16 when releasing a blast of compressed air, the entire clearance 27,28 is filled with compressed air, in practice without delay or pressure drop. The variations in the volumes of the clearances 27 and 28 is not measurably disadvantageous. Whenever a valve 20 opens, the piston 23 is struck with the full blast of the compressed air storer. Whether a larger or a smaller clearance 27 or 28 between the piston 23 and the walls 25,26 is hit by compressed air is of practically no importance.

If, however, the short, additional traversing movements of the cam drum 9 are to be taken in account exactly, it is also contemplated according to certain preferred embodiments of the invention to arrange the cylinder 22 adjustably in longitudinal direction. For this purpose, the cylinder 22 is supported slidably by means of a holding device, denoted only by a dot-dash line, on a threaded spindle 31 of a regulating motor 30. The regulating motor 30 is controlled through a small computer 32 by a command transmitter of the traversing gear 8. The cylinder 22 can then execute, according to the adjusted directions F–G, the traverse movements according to the traverse directions D and E of the cam drum 9.

Figure 2:
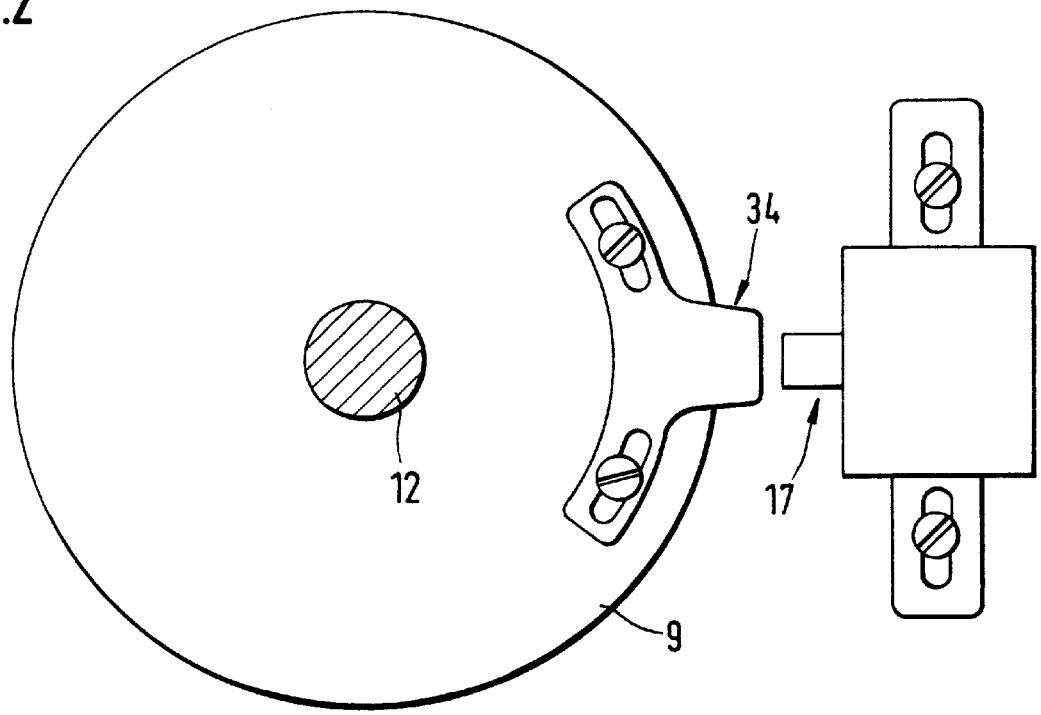
FIG. 2 is an end sectional view of an enlarged drawing of a cam drum comprising a signal transmitter adjacent which a signal receiver is arranged, in accordance with a preferred embodiment of the invention.

FIG. 2 shows an embodiment of how the signal transmitter 34 arranged at the signal receiver 17 can be arranged at the front side (end face) of a cam drum 9. The cam drum 9 is driven by means of a drive shaft 12. If the bead or the groove 10 of the cam drum 9 is applied favorably such that the traverse rod reversals correspond to different predetermined rotational positions of the cam drum, it is sufficient to provide only a single signal transmitter 34. It is of course possible to apply, in a way not shown, an extra signal transmitter for each of the two return motion points.

The signal transmitter 34 is adjustable in slots in circumferential direction. The adjustment is regulated according to the length of time in which the signal transmitter advances the activation of the auxiliary traversing device 15. When the valves 20 receive the signal to open, a very short time passes, which must be taken into account. The signal must advance for at least this very short time, that is, the signal must be given in time so that the blast of compressed air arrives at the machine end in time.

Standard sensors or a modern magnet material can be used as a signal transmitter, of which there are many possibilities. It is advisable to adjustably arrange also the signal receiver 17, which is electrically connected with the auxiliary traversing device 15.

Figure 3:
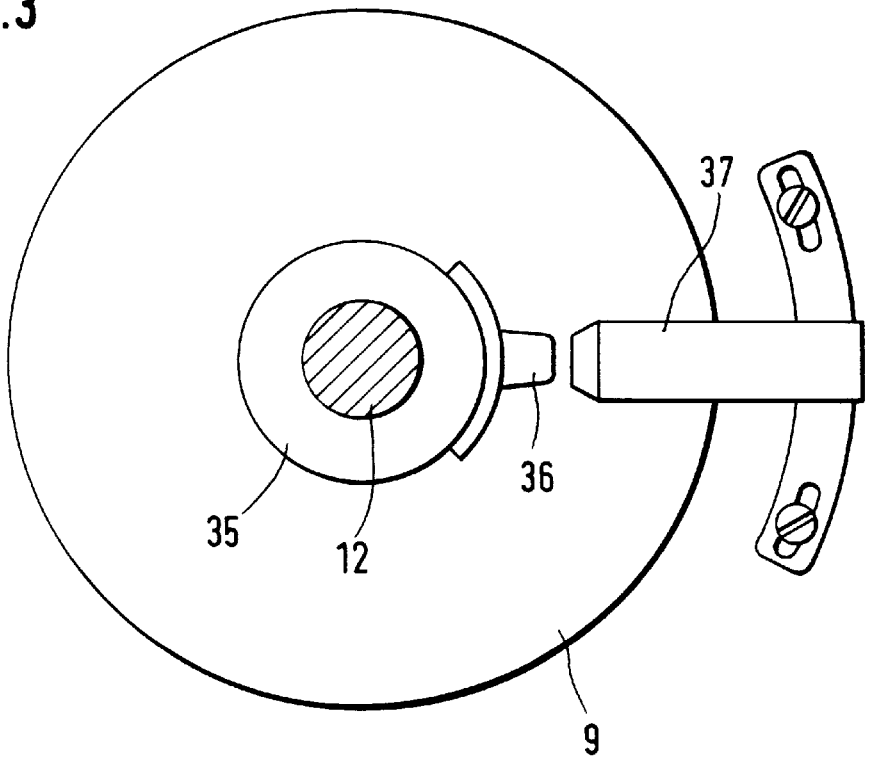
FIG. 3 is a drawing similar to FIG. 2, whereby the signal transmitter is arranged on a drive shaft which is connected with the cam drum, in accordance with another preferred embodiment of the invention.

In FIG. 3 it is shown that a signal transmitter 36 arranged at the signal receiver 37 does not necessarily have to be applied to the cam drum 9 itself, but rather can be applied to its drive shaft 12. The drive shaft 12 is provided with a disc 35 for this purpose, to which the signal transmitter 36 is applied. A plurality of signal transmitters can, of course, be provided, as opposed to the single one in the drawing, as long as an extra signal transmitter 36 is necessary for each return or reversal of motion.

It can be practical to apply the signal transmitter or transmitters, as mentioned above, to the traversing rod 3 itself, namely there where they originate on the traversing gear 8, that is, not too far away therefrom. In this case, a side to side movement is to be reckoned with and not the above mentioned angle position.

Figure 4:
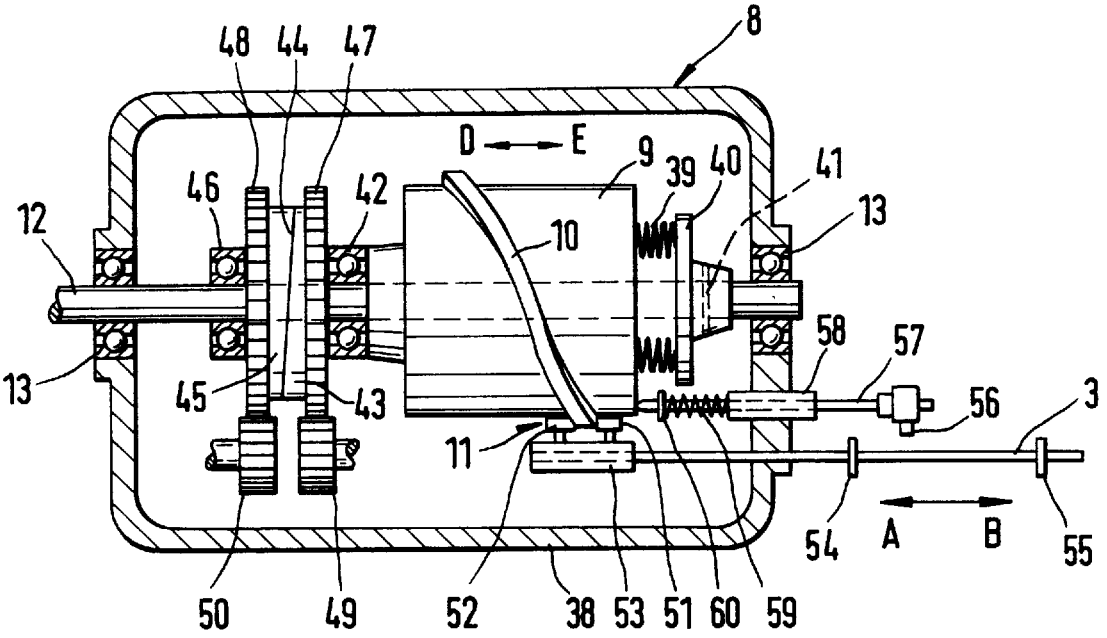
FIG. 4 is an enlarged part view of FIG. 1 in the area of a traversing gear.

An embodiment of this kind is shown in FIG. 4, from which the directions of movement A and B of the traversing rod 3, as well as the traverse directions D and E of the cam drum 9 can be seen. Furthermore, a bead 10 of the cam drum 9, the respective guiding element 11, the drive shaft 12 and the bearing 13 of the traversing gear 8 are illustrated in FIG. 4.

The traversing gear 8 is housed in the inside of a gear box 38. The cam drum 9 is pressed to one side, in FIG. 4 to the left side, by means of springs 39, which are effective against an end face. The springs 39 are supported against a disc 40, which is affixed to the drive shaft 12 by means of a pin 41. The disc 40 thus rotates with the cam drum 9.

On the other side, the cam drum 9 is supported by a thrust bearing 42, which is in turn supported by a disc 43. This disc 43 is movable in longitudinal direction, as is the thrust bearing 42. The disc 43 comprises a slanted front surface 44 on the side facing away from the cam drum 9, which slanted front surface 44 is arranged at an accordingly formed slanted surface of a counterdisc 45. The counterdisc 45 is combined with a strong ball bearing 46, and is not movable in longitudinal direction. The discs 43 and 45 are stationarily connected to gearwheels 47 and 48. The drive shaft 12 rotates therein, without the gearwheels 47 and 48 rotating.

The gearwheels 47 and 48 are adjustable by means of driving wheels 49 and 50. It is thus possible to turn the discs 43 and 45 in opposite directions. The slanted surface 44 of the discs 43 and 45 effects then a change in the distance between the gearwheels 47 and 48. With increasing distance, the thrust bearing 42 is pushed, together with the cam drum 9, against the springs 39. Thus a lifted displacement of the traversing rod 3 arises, which in turn receives its drive from the cam drum 9.

The bead 10 of the cam drum 9 is encircled by rollers 51 and 52. When the traversing rod 3 is pushed in direction of motion B, the roller 51 is subjected to stress, when the traversing rod 3 is being pulled in direction of motion A, it is the roller 52 which is subjected to stress. Both rollers 51 and 52 are applied to one holding device 53, in which the traversing rod 3 is inserted. The traversing rod 3 can be adjusted and affixed in both directions in this holding device 53.

The edge laying of the packages 2 according to the traversing movements D–E of the cam drum 9 involves measurements of millimeters. As a rule, the cam drum 9 is permitted to traverse about 4 mm towards each side, in order that the desired soft edge of the package 2 is attained.

When the signal for the auxiliary traversing device 15 is to be transmitted from the traversing rod 3, it comprises for this purpose two signal transmitters 54 and 55 in direct proximity of the gear box 38. A signal receiver 56 is arranged for both signal transmitters 54 and 55. Whenever one of the two signal transmitters 54 or 55 traverses past the signal receiver 56, the result is a signal, which is transmitted on from the signal receiver 56 to the auxiliary traversing device 15. The signal transmitters 54 and 55 are adjustable on the traversing rod 3, in particular because the signals may have to be transmitted longer or shorter in advance.

If the signal receiver 56 were stationarily arranged, a fault would occur in the case of the edge laying according to the traverse directions D and E of the cam drum 9. The signals to the auxiliary traversing device 15 would be given namely at the wrong moment. In order to avoid this fault, the signal receiver 56 is arranged on a rail 57. The rail 57 is supported on the front side of the cam drum 9. The rail 57 is inserted into a bearing bush 58. By means of a pressure spring 59, the rail 57 is continuously placed, with a low amount of pressure, against the front side of the cam drum 9. The rail 57 comprises a disc 60 or a corresponding cross pin for supporting the pressure spring 59.

On the other side, the pressure spring 59, in the form of a helical spring, is placed against the bearing bush 58.

By means of this device it is ensured that the signal receiver 56, together with the cam drum 9 traverses from side to side, so that the signals, released by the signal transmitters 54 and 55, always arrive at the correct moment at the auxiliary traversing device 15. The time shift corresponds to the small traverse movements according to the traverse directions D–E of the cam drum 9.

Figure 5:
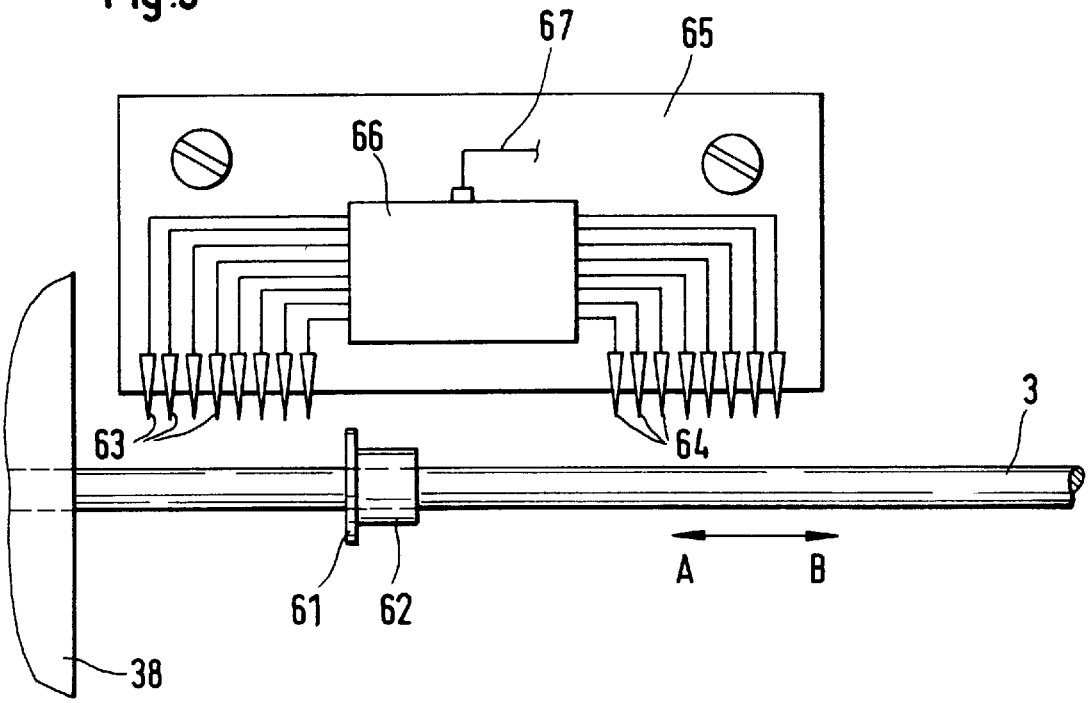
FIG. 5 is an enlarged drawing of a section of a traversing rod on which a signal transmitter is arranged, in accordance with preferred embodiments of the present invention.

FIG. 5 shows another solution, should a signal transmitter 61 be applied directly to the traversing rod 3 in close proximity to the gear box 38. The signal transmitter 61 is movable on the traversing rod 3 for the purpose of adjustment by means of a bush bearing 62.

With each back-and-forth stroke, the signal transmitter 61 travels along a row of signal receivers 63 and 64, whereby the signal receivers 63 in the direction of motion A and the signal receivers 64 in the direction of motion B are traversed. There is a plurality of very closely arranged adjacent signal receivers 63 and 64. In order that this design can be practically realized, taking into consideration its size, the signal receivers can be arranged at right angles to each other, which is not shown in FIG. 5.

The receiver rail 65 has an extension in longitudinal direction of the traversing rod 3, which extension corresponds to the stroke of the traversing directions D and E of the cam drum 9.

Without the traverse movements of the cam drum 9, the respective outer signal receivers 63 or 64 would not be overrun. If, during application of the lifting displacement, the cam drum 9 is shifted sideways, then—depending on the direction of the shift—more outward signal receivers 63 and 64 would be overrun, as if no edge laying were taking place. A computer 66 registers hereby which signal receivers 63 or 64 have been overrun, and recognizes the traverse movement triggered by the cam drum 9. The relevant signals can thus be transmitted further down an electric wire 67 to the auxiliary traversing device 15. The initiators 19 can thereby activate the auxiliary traversing device 15 at the correct moment.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. A yarn traversing device for a textile machine which in use produces a plurality of cross-wound yarn packages at respective winding stations, comprising:

a traversing rod extending in use in a machine longitudinal direction adjacent a plurality of respective winding stations, said traversing rod carrying respective yarn guides for guiding yarn to form respective yarn packages at the respective winding stations, a traversing drive device drivingly moving the traversing rod in respective back-and-forth longitudinal directions with consequent alternating tension and compression forces on the traversing rod, at least one auxiliary traversing drive device spaced longitudinally from the traversing drive device and operable to apply auxiliary driving forces to the traversing rod when said traversing rod movement direction is reversed by said traversing drive device, and an auxiliary traversing device control system including a signal generator for generating a traversing drive position signal representative of the position of the traversing drive device and operable to activate the auxiliary traversing device in respective back-and-forth longitudinal directions synchronously as a function of said traversing drive position signal.

2. A yarn traversing device according to claim 1, wherein the traversing drive device comprises a cam drum, and wherein the signal generator is operable to monitor a position of one of said cam and a component movable together with said cam.

3. A yarn traversing device according to claim 2, wherein at least one signal receiver is arranged spatially with respect to the signal generator, which at least one signal receiver is electrically connected to an initiator of the at least one auxiliary traversing drive device.

4. A yarn traversing device according to claim 3, wherein the traversing drive position signal is timewise slightly ahead of an impulse transmitted by the initiator to the auxiliary traversing drive device.

5. A yarn traversing device according to claim 4, wherein said at least one auxiliary traversing device includes a plurality of auxiliary traversing drive devices provided along the length of the traversing rod.

6. A yarn traversing device according to claim 4, wherein the at least one auxiliary traversing drive device comprises a pneumatic piston-cylinder unit.

7. A yarn traversing device according to claim 4, wherein the cam drum is periodically driven to make further small traverse movements of the traversing rod in the range of +/−4 mm to improve edges of the packages, and wherein the signal generator is operable to accommodate these further small traverse movements.

8. A yarn traversing device according to claim 3, wherein the cam drum is periodically driven to make further small traverse movements of the traversing rod in the range of +/−4 mm to improve edges of the packages, and wherein the signal generator is operable to accommodate these further small traverse movements.

9. A yarn traversing device according to claim 3, wherein said at least one auxiliary traversing device includes a plurality of auxiliary traversing drive devices provided along the length of the traversing rod.

10. A yarn traversing device according to claim 3, wherein at least one energy storer, charged by the traversing rod itself, is arranged at the traversing rod.

11. A yarn traversing device according to claim 3, wherein the at least one auxiliary traversing drive device comprises a pneumatic piston-cylinder unit.

12. A yarn traversing device according to claim 2, wherein said at least one auxiliary traversing device includes a plurality of auxiliary traversing drive devices provided along the length of the traversing rod.

13. A yarn traversing device according to claim 2, wherein the cam drum is periodically driven to make further small traverse movements of the traversing rod in the range of +/−4 mm to improve edges of the packages, and wherein the signal generator is operable to accommodate these further small traverse movements.

14. A yarn traversing device according to claim 1, wherein said at least one auxiliary traversing device includes a plurality of auxiliary traversing drive devices provided along the length of the traversing rod.

15. A yarn traversing device according to claim 14, wherein said at least one auxiliary traversing drive device includes a plurality of auxiliary traversing devices, and wherein each auxiliary traversing drive device comprises a pneumatic piston cylinder unit.

16. A yarn traversing device according to claim 14, wherein the cam drum is periodically driven to make further small traverse movements of the traversing rod in the range of +/−4 mm to improve edges of the packages, and wherein the signal generator is operable to accommodate these further small traverse movements.

17. A yarn traversing device according to claim 1, wherein at least one energy storer, charged by the traversing rod itself, is arranged at the traversing rod.

18. A yarn traversing device according to claim 17, wherein the cam drum is periodically driven to make further small traverse movements of the traversing rod in the range of +/−4 mm to improve edges of the packages, and wherein the signal generator is operable to accommodate these further small traverse movements.

19. A yarn traversing device according to claim 1, wherein at least one energy storer is provided which is charged by the movement of the traversing rod and is separate from the at least one auxiliary traversing drive device.

20. A yarn traversing device according to claim 19, wherein the at least one energy storer includes a spring connected at one end to the traversing rod.

21. A yarn traversing device according to claim 1, wherein the at least one auxiliary traversing drive device comprises a pneumatic piston-cylinder unit.

22. A yarn traversing device according to claim 21, wherein the cam drum is periodically driven to make further small traverse movements of the traversing rod in the range of +/−4 mm to improve edges of the packages, and wherein the signal generator is operable to accommodate these further small traverse movements.

23. A yarn traversing device according to claim 1, wherein the traversing drive device is at one end of the traversing rod and the at least one auxiliary traversing drive device includes an auxiliary traversing drive device at an opposite end of the traversing rod.

24. A yarn traversing device according to claim 23, wherein the traversing rod is more than 10 meters long.

25. A yarn traversing device according to claim 24, wherein the traversing rod is more than 20 meters long.

26. A yarn traversing device according to claim 25, wherein the traversing rod is 30 meters long.

27. A yarn traversing device according to claim 1, wherein the auxiliary traversing drive device includes a piston carried by the traversing rod and movable in a cylinder with closed wall end sections communicated with respective compressed air blast sources operable in response to the control system.

* * * * *